United States Patent [19]

Miller

[11] Patent Number: 5,028,909

[45] Date of Patent: Jul. 2, 1991

[54] GOLF BAG ALARM

[76] Inventor: Robert A. Miller, 315 Nicolaus Dr., North Fort Meyers, Fla. 33903

[21] Appl. No.: 509,224

[22] Filed: Apr. 16, 1990

[51] Int. Cl.[5] ..... G08B 21/00

[52] U.S. Cl. ..... 340/568; 206/315.3; 206/315.6; 273/32 E

[58] Field of Search ..... 340/568; 273/32 E; 206/315.3, 315.6

[56] References Cited

U.S. PATENT DOCUMENTS 3,980,115 9/1976 Longo ..... 206/315.6

4,042,918 8/1977 Klitzman ..... 340/568

*Primary Examiner*—Glen R. Swann, III

*Attorney, Agent, or Firm*—Polster, Polster and Lucchesi

[57] ABSTRACT

In combination with a golf club holder, sometimes referred to as a golf bag, an alarm system reminds golfers when golf clubs are missing from the golf bag. The alarm system includes a plurality of signaling devices which can be light emitting diodes. The golf bag includes a plurality of stations into which the golf club shafts fit grip first. Each station includes a switch, the switches being electrically connected in parallel to a source of electricity. The switches are biased to such a position that the signaling device is energized when a golf club is withdrawn from the station and de-energized when the golf club is returned. The LED display may be mounted on the golf bag or may be connected to an extension cord to be mounted in the front of a golf cart.

7 Claims, 2 Drawing Sheets

GOLF BAG ALARM

BACKGROUND OF THE INVENTION

This invention relates to an alarm system for a golf bag or the like to inform golfers when golf clubs are missing from the bag. The term "bag" is used broadly to include any holder or carrier, such, for example, a metal or plastic rack in which club receiving tubes are supported, as well as a conventional leather, cloth or plastic bag.

On many golf courses, golf carts are restricted to golf cart paths and may not be driven on the fairway or the green. Thus, when golfers use golf carts, they often take more then one club from the bag when they expect to make several shots before returning to the cart. The golfer generally lays the extra clubs on the ground while he uses the needed club. Often times, he will forget to pick up the clubs. Not infrequently, especially if the extra clubs are not needed for the next few holes, he will forget where the clubs were left, resulting in the inconvenience of not having the clubs when next they are needed, and the considerable expense of replacing the clubs if they are not found.

One of the objects of this invention is to provide a device to alert a golfer that one or more of his golf clubs have not been replaced in his golf bag after being previously withdrawn;

Another object is to provide such a device that is reliable, durable and relatively inexpensive as compared with the cost of replacing golf clubs.

Other objects will be apparent to those skilled in the art in light of the following disclosure and accompanying drawings.

SUMMARY OF THE INVENTION

In accordance with this invention, generally stated, a holder for golf clubs, each golf club including a shaft, a head at one end of the shaft, and a handle or grip at the other end is equipped with an alarm system. The holder includes a station for each of a multiplicity of golf clubs, and a switch means at each of the stations. The switch means are part of an electrical circuit, including a plurality of electrical conductors that connect the switch means to a current source and to alarm means. The switch means is biased to a position at which the electrical circuit is completed to alarm means when a golf club is withdrawn. The switch means is adapted to be moved by a golf club when it is inserted into the station to de-energize the alarm means.

In one embodiment, the holder includes a housing which carries the current source and the alarm means. The housing may include extension means, connected at one end to the housing and connected to alarm means at the other, so that alarm means can be mounted to a surface remote from the holder.

In the preferred embodiment, the holder stations comprise tubes having a cylindrical side wall, a bottom, and an upwardly opening mouth into which the shafts of individual golf clubs are inserted, grip first.

In one embodiment of the switch means, each tube has a slot in the wall near the bottom. The switch means comprises a blade bent to project through the slot into the tube, the blade being biased to normally be in contact with a fixed contact. The blade projects into the tube a sufficient distance, so that when the golf club is inserted into the tube, the shaft of the club pushes the blade out of contact with the fixed contact, thereby de-energizing the alarm.

In another embodiment of the switch, a fixed contact and a movable contact biased to be normally in contact with the fixed contact, are positioned beneath the tube bottom. The tube bottom has a bore through it. A downwardly extending pin passes through the bore a sufficient distance to contact the movable contact. A plate is mounted on the top of the pin. When the club is inserted into the tube grip-first, the weight of the club pushes down on the plate to move the movable contact out of contact with the fixed contact.

Each switch may be connected to a single source of current, or each switch may have its own power source. The source can be any suitable source, such as dry cell batteries, or rechargable batteries, either charged by a charging circuit connected to a conventional AC source, or charged by solar energy, or, as is explained hereinafter, the batteries of a golf cart. The alarm means in the embodiment shown includes at least one light emitting diode which lights when a golf club is removed. The LED may be mounted on a housing on the holder, or on a display terminal on the dash board or steering column of a golf cart, or both the holder and the forward part of the cart, for example.

DESCRIPTION OF THE PREFERRED EMBODIMENT

Figure 1:
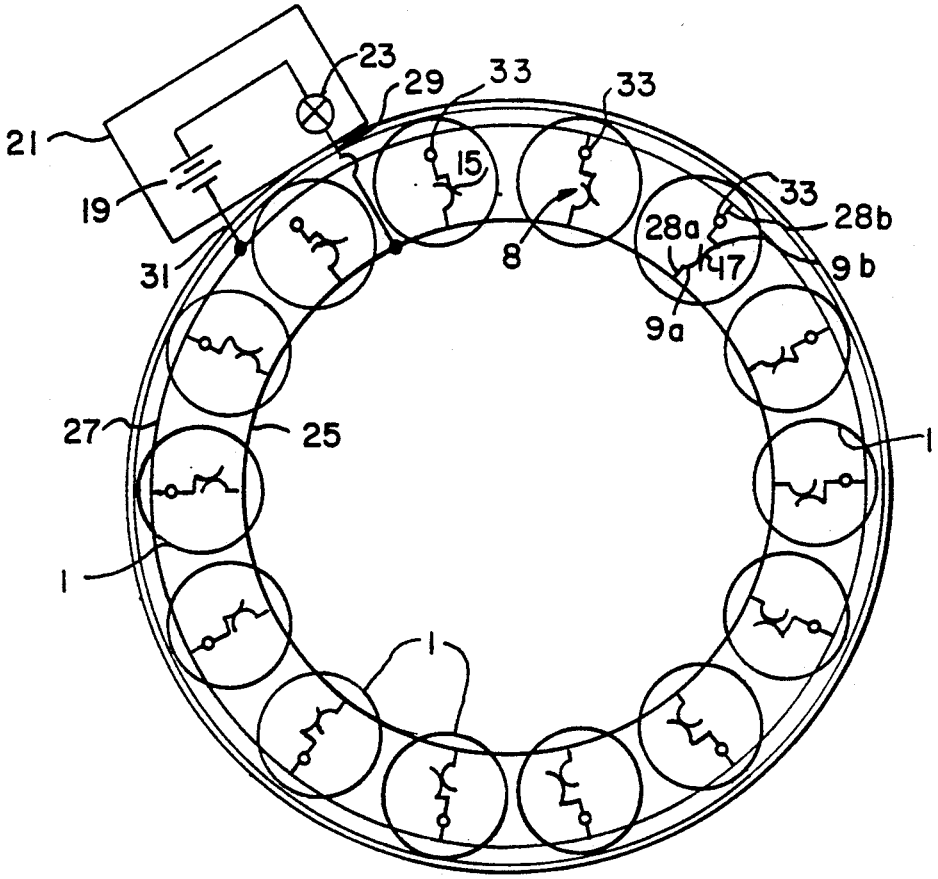
FIG. 1 is a schematic view showing an electrical circuit of one embodiment of the alarm of the present invention.
Figure 2A:
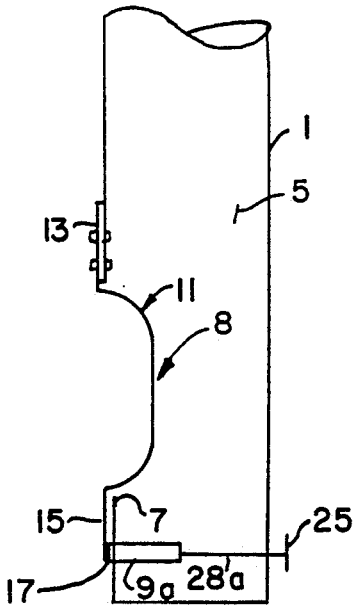
FIG. 2A is a fragmentary side elevational view of a golf club station embodying the alarm circuitry of FIG. 1, showing a switch mounted on the side of a golf club-receiving tube.
Figure 2B:
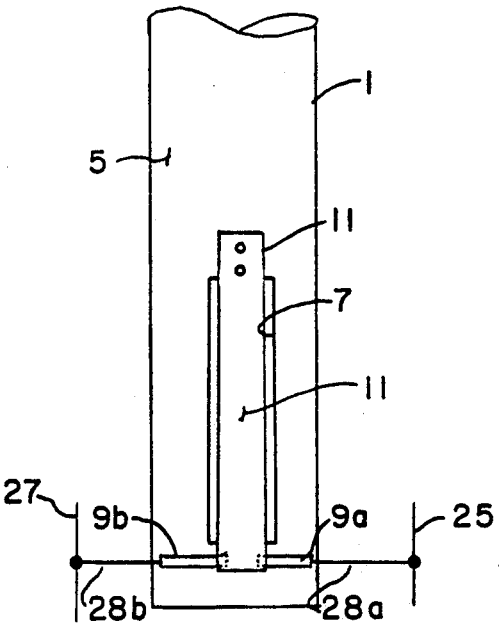
FIG. 2B is a front elevational view of the golf club station of FIG. 2A.
Figure 3:
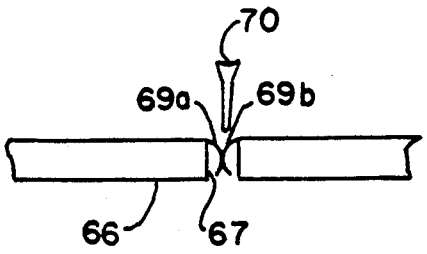
FIG. 3 is a fragmentary cross-sectional view of a top plate of a golf bag, showing a switch that can be disabled with a tee when its associated station will not be carrying a golf club.

In a first embodiment shown in FIGS. 1-3, reference numeral 1 refers to a tube into which a golf club is inserted grip-first when the club is not in use. Tube 1 is preferably held in a golf bag having a top plate which supports and spaces the tubes and adds structural support to the bag so that it may more easily be carried in a golf cart. The tube may be integral with the top plate, or mounted in an opening in it. Conventionally, there are enough tubes to accomodate fourteen clubs, but the number may vary.

Tube 1 includes a cylindrical side wall 5 having a slot 7 and a switch 8, having a pair of fixed contacts **9*a* and 9*b* and a movable flexible blade 11 mounted at its upper end 13 on tube 1 above slot 7. Fixed contacts 9*a* and 9*b* are mounted to the outside of tube 1 beneath slot 7 in spaced relation to each other. Flexible blade 11 extends through the length of the slot 7 and beyond the lower end of the slot. At its lower end 15, which projects beyond the lower end of the slot 7, the blade has a contact end 15. Contact end 15 carries a contact 17 which spans the space between contacts 9a and 9b. Through a section that extends along the slot 7, blade 11 is shaped to extend into tube 1 through slot 7 between the fixed and contact ends. The resilience of the blade 11 biases the contact 17 into electrical and mechanical contact with the contacts 9a and 9b when there is no golf club in tube 1, and the alarm is energized, as will be explained below. Blade 7 extends sufficiently far into tube 1, so that when a golf club is inserted into tube 1, the grip or handle will push movable end 15 and contact 17 away from fixed contacts 9a and 9b** to break the electrical circuit and de-energize the alarm.

The contacts 9a and 9b may be electrically connected to a single source of electricity, in the embodiment shown, batteries 19 as is shown in FIG. 1. In this embodiment, a power pack 21, containing the batteries 19, and an on/off switch 23 electrically connected to the batteries, is physically connected to the golf bag. The power pack 21 is electrically connected to a pair of wires 25 and 27 by wires 29 and 31. The switches of all the tubes are connected in parallel between wires 25 and 27. Wire 25 is connected to fixed terminal 9a by a wire 28a and wire 27 is connected to the fixed terminal 9b by wire 28b. Thus, when blade 11 is not in contact with terminals 9a and 9b, the circuit is broken and the alarm will not be energized.

In this embodiment, each tube 1 has associated therewith a light emitting diode (LED) 33, which is physically at the upper end of the tube and electrically connected to wire 28b which is shown for convenience in FIGS. 2A and 2B at the bottom of the tube but will in reality extend to the top of the tube where it is connected, by way of the LED 33 to the common wire 27. Alternatively, one LED can be electrically connected to the conductor 29 or 31 and none connected to the individual leads 28. This will signal that a club is missing but not which club. LED 33 may be mounted on a display panel associated with the power pack 21, or individual LEDs may be mounted at the top of the tube where it will be visible to a golfer.

The circuitry as described will cause an LED to light when a club is withdrawn from its respective tube 1. The LED will not be deactivated until the club is replaced. Thus, as long as there is a light on, the golfer will be reminded that not all of the clubs are in his bag when he returns to his bag and he will remember not to leave the golf clubs behind.

Figure 4:
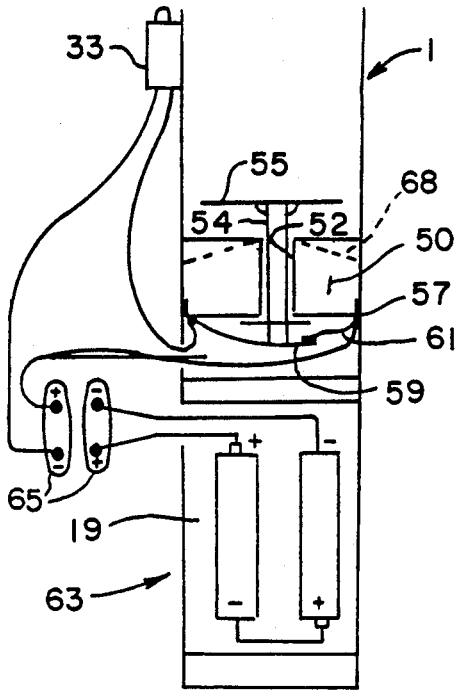
FIG. 4 is a cross-sectional view of a second embodiment of a switch, wherein the switch is at the bottom of a golf club station and wherein the station and its accompanying alarm system are completely self contained; and, FIG. 5 is an electrical diagram of the circuitry of FIG. 1 adapted for remote mounting of the alarm means.

A second embodiment of switch is shown in FIG. 4. In this embodiment, tube 1 has a bottom plug 50 with a centrally located hole 52 through it. A push rod 54 having a plate 55 mounted on its upper end extends through hole 52. A fixed L-shaped contact 57 and a moveable spring contact 59 are mounted to the tube beneath tube bottom 3. Movable contact 59 is normally biased to be in contact with the underside 61 of contact 57. Push rod 54 is of sufficient length to be in contact with, and light enough to be supported by, the spring bias of moveable contact 59. The contacts are connected to an LED 33 and a power supply 19. When a golf club is inserted into tube 1, the weight of the club causes the end of the shaft to push down on plate 55 and rod 54, moving the contact 59 away from contact 57. Thus, the club breaks the electrical connection and the LED will not light. When the golf club is withdrawn, contact 59 springs up to connect with contact 57 and the LED lights up, to remind the golfer his club is withdrawn. Channels 68 in the plug 50 open at their outer ends through openings in the tube to permit sand and grit to fall outside the tube. If desired, a compression spring can be positioned between the top of the plug 50 and the underside of the plate 55 to help bias the rod away from the contact 59 when the club is withdrawn.

FIG. 4 shows tube 1 as equipped with its own power supply 63 beneath tube 1. The power supply consists of batteries electrically connected on one side to the contact 57 and on the other, to one side of the LED 33, all through snap connectors 65. The other side of the LED is connected to the contact 59. However, it may be connected to a common power supply for all the switches, as in FIG. 1. Similarly, each switch of FIG. 2 may have its own power supply, as in FIG. 4.

A third switch embodiment is shown in FIG. 3, wherein a top plate 66 has a series of openings 67 for receiving golf club shafts, either wooden or provided with a plastic skin or sleeve. A pair of flexible contacts 69a and 69b protrude into the opening to be normally in contact with each other. Contacts 69a and 69b are connected to a source of current and alarm means as in FIGS. 1 or 4. In this embodiment, when a club is withdrawn from opening 67, the terminals 69a and 69b will contact each other and the alarm will be energized. When the club is replaced, the sleeve or skin area of the club will be between the terminals, the terminals 69a and 69b will be separated, and the alarm will be de-energized. In this embodiment, when a golfer will not be carrying all his golf clubs, a tee 70 may be inserted between terminals 69a and 69b to deactivate the alarm, so that the golfer will not be given a false alarm.

In the other embodiments, either an auxiliary switch can be provided, which could be in the nature of the switch shown in FIG. 4, physically beneath a small hole and electrically in the electric circuit to the alarm, or any other suitable switch, or a dowel can be inserted in the otherwise empty tube. As has been noted, FIGS. 1 and 4 show each tube with its own warning light 33. There may alternatively be only a single warning light 33 which is placed on the power pack. This however, would only inform a golfer that a club in missing. It would not inform the golfer which club is missing.

Figure 5:
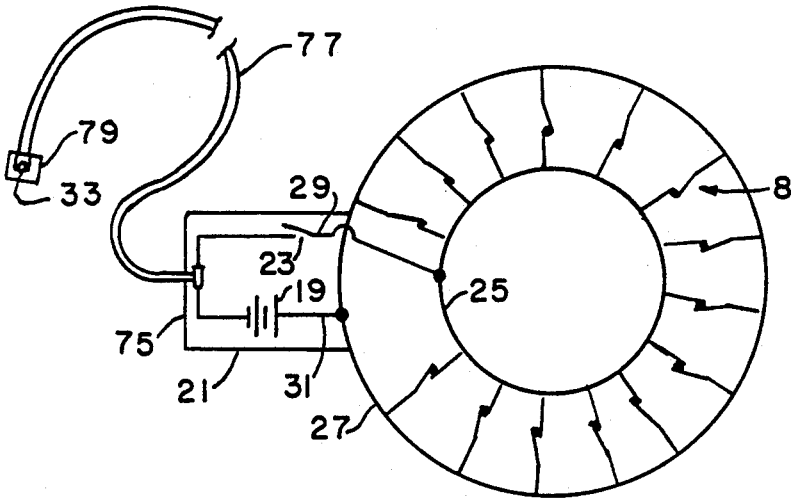

In another display embodiment shown in FIG. 5, the display of one or more LEDs may be mounted to a surface in the front of the golf cart where the golfer is more likely to see the LED display. In this embodiment, power pack 21 includes a receptacle 75 which receives one end of an extension cord 77, which is electrically connected to the battery. The extension cord leads from the receptacle in the back of the cart to a display panel 79, containing one or more LEDs 33, which may be mounted in the front of the cart. In this embodiment, if a golfer does not look at his bag when he approaches the golf cart to drive to the place at which he is to make his next shot, whether tee, green, or fairway, he is more likely to see the display at the front of the cart, and thus is more likely to be reminded of missing clubs.

Numerous variations in the alarm system of this invention, within the scope of the appended claims, will occur to those skilled in the art in the light of the foregoing disclosure. Merely by way of illustration, a strobe light can be used instead of the LED or the LED can be replaced by or augmented by an audible signal or a different sort of visual signal, as, for example, a flag or pop-up stem. If the device is to be installed in a cart, the power can be supplied by the cart batteries, and an outlet box can be mounted on the cart into which the bag circuit can be plugged with a jack, in which case, the alarm can be carried permanently by the cart or the outlet box. Conversely, the alarm system can be carried by the bag or can be made part of a bag insert consisting of the top plate and depending tubes, the LEDs or other alarm means being carried by the plate and the power pack, which can be made very light and compact, being mounted on the plate also, or housed in a housing made integral with or at least permanently attached to the top plate. In place of the extension cord from the housing to the forward part of the golf cart, other means of transmission can be used. For example, a small, very low power RF signal generator can be connected to be operated in parallel with the LED circuit, and a receiver mounted on the dash board or steering column of the cart, the reception of a signal from the generator triggering an alarm at the forward part of the cart. Various other types of switches, such, for example, as reed switches operated by the movement of a magnet displaced by a club, or microswitches that are readily available, with plungers or wobble type actuators can be used. In the embodiment of FIGS. *2a* and *2b*, one side of the circuit can be connected to the flexible blade, and the other to one fixed contact, rather than to two fixed contacts. Although the arrangement of switches normally biased to closed position to complete the alarm circuit has marked advantages in simplicity, a circuit can be used in which the alarm itself is normally actuated in response to a solenoid's not being energized, the switches are normally biased open, and are closed when a golf club is inserted in its holder, to energize the solenoid, to open the alarm circuit. The receptacle on the holder or on the cart can be equipped with a jack socket to permit the extension cord, equipped with a jack, to be plugged in if the remote signal is to be used. If individual tubes with a self-contained alarm system exemplified by the embodiment shown in FIG. 4 are used, one or more of the tubes can be employed to receive the clubs most likely to be left behind, and the rest, left unequipped with the system, inasmuch as it would be rare to drop a 1- or 2-wood , for example. Even the system with a single set of conductors serving a multiplicity of tubes can be arranged to leave some tubes unserved. These are merely illustrative.

Having thus described the invention, what is claimed and desired to be secured by Letters Patent is:

1. In combination with a holder for golf clubs, said holder having a station for each of a multiplicity of said clubs, each of said golf clubs having a shaft, a head at one end of said shaft, and a grip or handle at the other end thereof, an alarm system comprising a source of current, switch means at each of said stations, a plurality of sets of electrical conductors electrically connected to said switch means, one set to said source of current, and another to alarm means, said switch means being normally biased to a position at which said alarm means is energized, said switch means being moved by the insertion of a club into said station to de-energize said alarm means, said holder further including a top plate having a plurality of openings for receiving said golf club shafts, said switch means comprising a pair of flexible contacts protruding into said opening to normally be in contact with each other, said terminals being connected to said alarm means and said source of current, wherein said contacts are separated when a golf club shaft is inserted into said station, de-energizing said switch, and said contacts electrically connect when said shaft is withdrawn, energizing said alarm.

2. The improvement of claim 1, wherein each station has associated therewith its own source of current.

3. In combination with a holder for golf clubs, said clubs, said holder having a station for each of a multiplicity of said clubs, each of said golf clubs having a shaft, a head at one end of said shaft, and a grip or handle at the other end thereof, an alarm system comprising a source of current, switch means at each of said stations, a plurality of sets of electrical conductors electrically connected to said switch means, one set to said source of current, and another to alarm means, said switch means being normally biased to a position at which said alarm means is energized, said switch means being moved by the insertion of a club into said station to de-energize said alarm means, said holder comprising a golf bag which carries said stations, said stations being defined by tubes having a side wall and an upwardly opening mouth into which the shafts of individual golf clubs are inserted handle first, each of said tubes including a slot in its side wall toward its bottom; said switch means comprising at least one fixed contact and a blade with a part projecting through said slot into said tube, said blade carrying a contact at one end and being biased normally to be in electrical contact with said fixed contact, said blade projecting into said tube a distance such that the handle of a golf club moves said blade out of electrical contact with said fixed contact when said golf club handle is introduced into said tube.

4. The alarm system of claim 3, wherein two, spaced fixed contacts are provided, each of said fixed contacts is connected to said current source and said contact on said blade spans the space between said contacts to complete the circuit when said blade is in contact with said fixed contacts.

5. The alarm system of claim 3, wherein each station has associated therewith its own source of current.

6. In combination with a holder for golf clubs, said clubs, said holder having a station for each of a multiplicity of said clubs, each of said golf clubs having a shaft, a head at one end of said shaft, and a grip or handle at the other end thereof, an alarm system comprising a source of current, switch means at each of said stations, a plurality of sets of electrical conductors electrically connected to said switch means, one set to said source of current, and another to alarm means, said switch means being normally biased to a position at which said alarm means is energized, said switch means being moved by the insertion of a club into said station to de-energize said alarm means, said holder comprising a golf bag which carries said stations, said stations being defined by tubes having a side wall and an upwardly opening mouth into which the shafts of individual golf clubs are inserted handle first, each of said tubes further including a bottom plug having a bore therethrough, said switch means comprising a fixed terminal and a moveable terminal beneath said tube bottom, said moveable terminal being normally biased to be in contact with said fixed terminal, a push rod extending through said bore to be in contact with said movable terminal, said shaft being of sufficient length, so that when the golf club is inserted into said tube, the weight of said golf club forces said moveable terminal out of electrical contact with said fixed terminal.

7. The alarm system of claim 6, wherein said push rod carries a plate at its upper end, and said station comprises at least one channel extending radially downwardly and outwardly and opening into at least one slot below said plate so that said switch will not be rendered inoperative by an accumulation of dirt, sand or the like.

* * * * *